United States Patent [19]

Bloom et al.

[11] 4,133,314

[45] Jan. 9, 1979

[54] EXTENSION TRANSFER SET

[75] Inventors: William G. Bloom, Los Angeles; Pradip V. Choksi, Northridge; Edmund E. Spaeth, Irvine, all of Calif.

[73] Assignee: American Hospital Supply Corporation, Evanston, Ill.

[21] Appl. No.: 747,418

[22] Filed: Dec. 6, 1976

[51] Int. Cl.[2] ..... A61J 1/00

[52] U.S. Cl. ..... 128/272.3; 141/27

[58] Field of Search ..... 128/272.3, 272, 221, 128/DIG. 26, 214.2, 218 NV, 218 PA, 214 R; 141/27

[56] References Cited

U.S. PATENT DOCUMENTS

| | | | |
|---|---|---|---|
| 2,668,533 | 2/1954 | Evans | 128/214 |
| 2,864,366 | 12/1958 | Miskel | 128/221 |
| 2,866,457 | 12/1958 | Moore | 128/214 |
| 2,999,499 | 9/1961 | Willet | 128/214 R |
| 3,022,784 | 2/1962 | Nuffer | 128/214 |
| 3,057,350 | 10/1962 | Cowley | 128/214 |
| 3,098,481 | 7/1963 | Wikander et al. | 128/215 |
| 3,344,785 | 10/1967 | Hamilton | 128/214 |
| 3,385,301 | 5/1968 | Harautuneian | 128/349 |
| 3,570,484 | 3/1971 | Steer | 128/221 X |
| 3,797,521 | 3/1974 | King | 137/525.7 |
| 3,822,700 | 7/1974 | Pennington | 128/214 |
| 3,935,883 | 2/1976 | Stach et al. | 128/214 R X |
| 3,977,555 | 8/1976 | Larson | 128/272 X |
| 4,046,145 | 9/1977 | Choksi et al. | 128/215 |

FOREIGN PATENT DOCUMENTS

| | | | |
|---|---|---|---|
| 796799 | 6/1958 | United Kingdom | 141/27 |
| 975873 | 11/1964 | United Kingdom | 128/274 |

*Primary Examiner*—Robert W. Michell
*Assistant Examiner*—Michael H. Thaler
*Attorney, Agent, or Firm*—Larry N. Barger

[57] ABSTRACT

A flexible transfer set for filling multiple syringes from a single bottle of medical liquid, as in a hospital pharmacy. The transfer set includes a flexible tube with a bottle connecting spike at one end and a syringe coupler at an opposite end. This syringe coupler includes a longitudinally collapsible valve that opens upon insertion of a blunt syringe tip and closes upon removal of such syringe tip. An external skirt on the coupler protects an entrance to the valve area.

16 Claims, 8 Drawing Figures

EXTENSION TRANSFER SET

BACKGROUND OF THE INVENTION

In hospitals hypodermic syringes are frequently prefilled with a particular dosage at the hospital pharmacy and then transferred to the hospital floor for administration to the patient. Frequently a diluent liquid, such as normal saline or sterile water, is added to a small amount of medication in a syringe to change the medication's concentration. These diluents, and sometimes the medications themselves, are supplied in bulk containers to the pharmacy. The pharmacist fills many hypodermic syringes from a single bulk container.

In the past, there have been complicated systems for connecting and disconnecting a series of syringes with a bulk container of liquid. These sometimes included rotatable stopcocks to start and stop the flow of liquid. This stopcock twisting procedure became very time consuming and tedious when several hundred syringes had to be filled during a day.

Another approach was to use a sharpened hypodermic needle on each syringe to puncture a rubber diaphragm to gain access to the sterile contents of the large reservoir container. A high number of repeated punctures through a single rubber diaphragm causes a problem in mechanical deterioration of the rubber. Small bits of rubber could be sucked into the syringe through its sharp piercing needle during filling.

SUMMARY OF THE INVENTION

We have overcome the above mentioned problems encountered in a hospital pharmacy. Our invention includes a flexible tube with a rigid bottle connecting spike at one end and a special valved coupler at the opposite end. This valved coupler requires neither a stopcock with its rotational motion requirement nor repeated punctures of a rubber diaphragm. The valved coupling has a collapsible internal valve member which automatically opens the valve upon connection of the coupler to a blunt externally tapered adapter of a conventional syringe. An example of such an adapter is one with a luer taper. An external skirt on the valved coupler protects its valve area from contamination.

DETAILED DESCRIPTION

Figure 1:
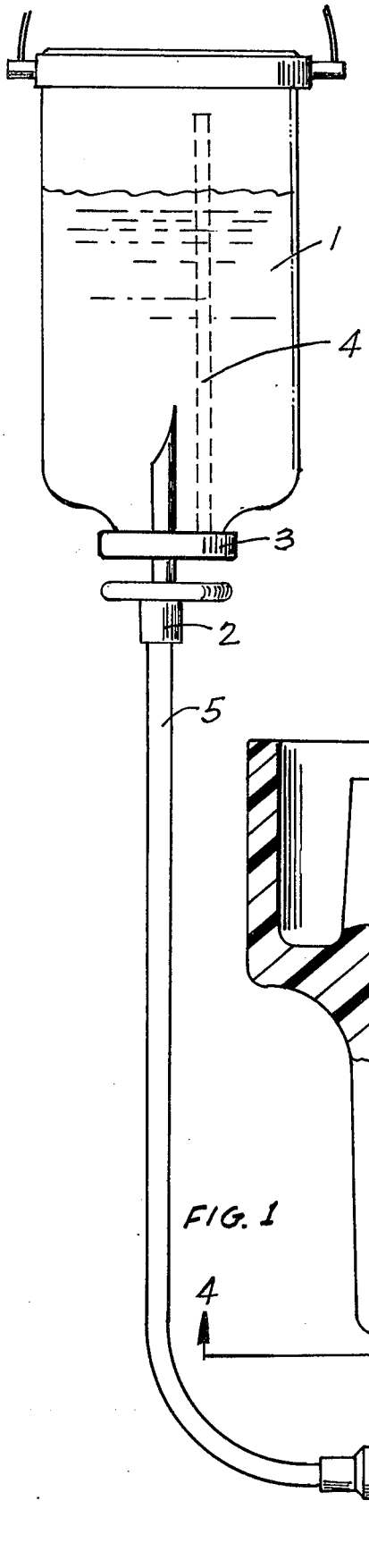
FIG. 1 is a front elevational view of the extension transfer set joining a liquid reservoir bottle with a hypodermic syringe.

Referring to FIG. 1 the assembled system includes a reservoir container, such as a 1 liter bottle of normal saline suspended in a mouth downward position. A rigid tubular spike 2 of the extension transfer set sealingly couples with a closure system 3 of bottle 1. This particular bottle has an air tube 4 to replenish air to the bottle as liquid is drained.

A flexible tube 5 has its upper end joined to tubular spike 2 and its lower end joined to a valved coupling 6. This valved coupling is in turn connected to a conventional hypodermic syringe 7.

Numerous syringes will be filled from this single reservoir bottle 1, and it is important to have a reliable valving system for quickly connecting and disconnecting each syringe. The valved coupler 6 requires only a simple longitudinal motion between the syringe and valved coupler for connecting and disconnecting.

Figure 2:
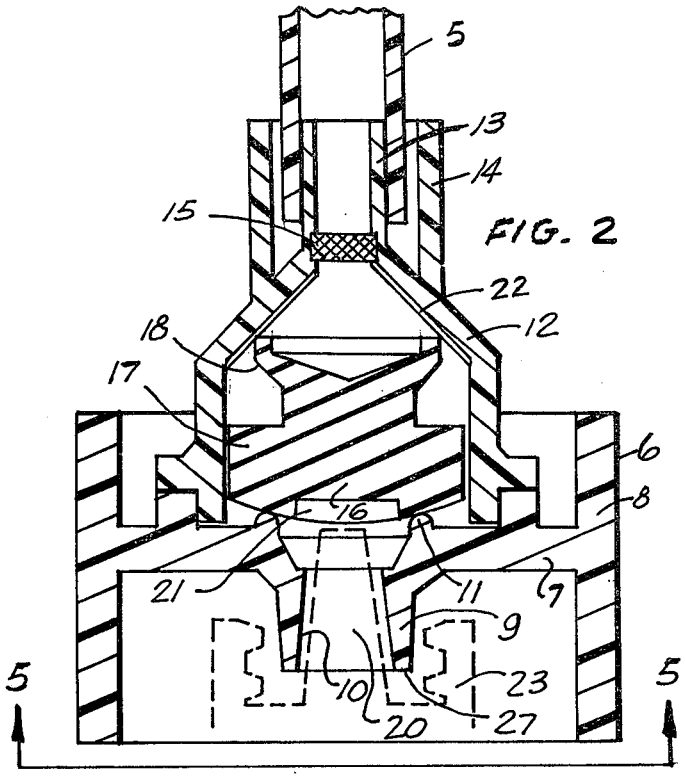
FIG. 2 is an enlarged sectional view of the valved coupler of the extension transfer set.

The details of the valved coupler are shown in FIG. 2. Here the coupler includes a body with a transverse wall 7 joined to a protector skirt 8. At a center of transverse wall 7 is a tubular syringe receiver 9 with a luer tapered internal wall surface 10. Transverse wall 7 also includes an annular sealing rib 11.

Sealingly joined to this coupler body by ultrasonic welding, solvent bonding, adhesive bonding, etc. is a hollow valve member housing 12 that includes a tubular tip 13. Sealingly connected to tubular tip 13 is an end portion of flexible tube 5. An external collar 14 serves to protect the joint between flexible tube 5 and tubular tip 13. This tubular tip 13 can also contain a filter 15 for removing any particulate matter that may be present in the reservoir container.

Confined within the valve member housing 12 is a longitudinally collapsible valve member 16. Valve 16 includes a sealing head 17 integrally joined to a longitudinally collapsible skirt 18. This skirt urges the sealing head 17 into sealing engagement with annular rib 11.

FIG. 2 shows a front portion of the hypodermic syringe with its conventional blunt tubular luer adapter or nozzle 20 being inserted in the tubular syringe tip receiver 9. As the syringe tip proceeds further into the coupler, it will contact sealing head 17 of the collapsible valve member pushing sealing head 17 away from annular sealing rib 11. A transverse groove 21 in sealing head 17 permits liquid to flow into the tubular syringe adapter it has passed through the optional filter 15 and through one or more grooves 22 in the valve member housing 12. Thus, when the collapsible valve member 16 is collapsed, liquid is free to flow around valve member 16 and into the syringe as its plunger is retracted.

After the syringe has been filled, the protector skirt 8 is grasped in one hand, the syringe barrel is grasped with the other hand, and the syringe and coupling separated with a simple longitudinal motion. This causes the valved coupling to automatically reclose. As shown in FIG. 2, the tubular syringe tip receiver has a wall thickness sufficiently thin to clear the internal threads of a needle retention sleeve that is present on some types of syringes. If desired, the tubular syringe tip receiver 9 could have external threads to mate with the threaded collar 23. As this would require a rotational motion for coupling and uncoupling the syringe, such structure has not been included in this preferred embodiment of our invention.

Figure 3:
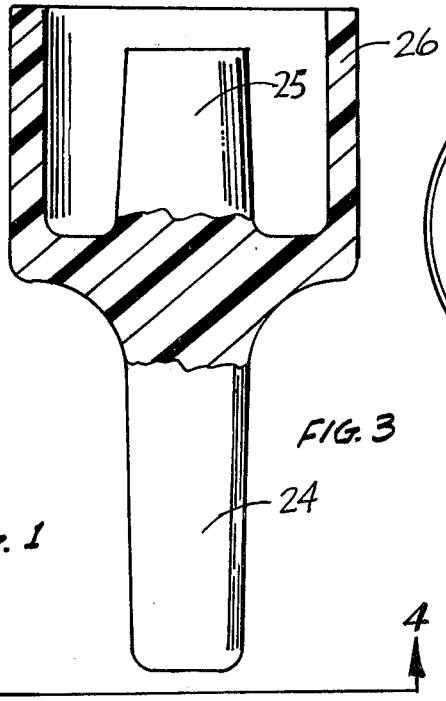
FIG. 3 is an enlarged sectional view of a removable protector for the valved coupler.
Figure 4:
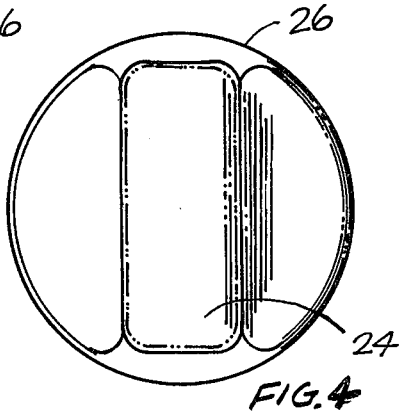
FIG. 4 is a view of the protector of FIG. 3 taken along line 4—4.

FIGS. 3 and 4 illustrate a protective cap for the tubular syringe tip receiver when a syringe is not connected to the valved coupler. This protector includes a handle 24, a luer wedge plug 25, and a protective skirt 26. The wedge plug 25 is recessed inwardly from the end of skirt 26 protecting the wedge plug 25 from inadvertent contamination. The wedge plug 25 fits against luer surface 10 of the tubular syringe tip receiver, while skirt 26 surrounds such syringe tip receiver 9. Preferably the luer surface 10 or wedge plug has a vent system of a groove or rib for passage of sterilizing gases.

Figure 5:
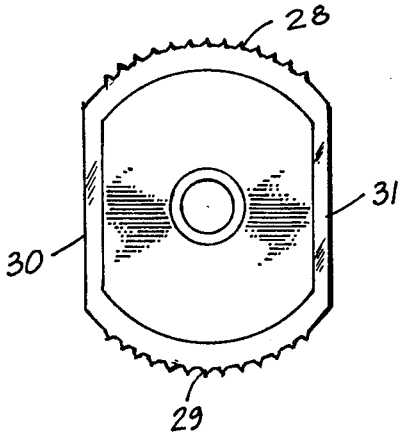
FIG. 5 is a bottom plan view of the coupler of FIG. 2 taken along line 5—5.
Figure 7:
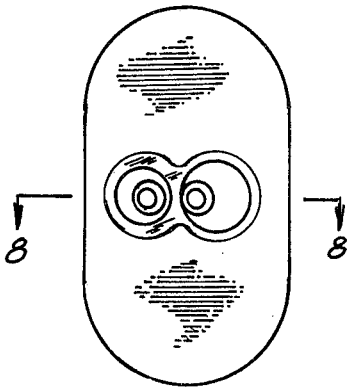
FIG. 7 is a top plan view of an alternate reservoir spike for the extension transfer set.

To provide a grasping area and protect the syringe tip receiver 9 from inadvertent contamination a skirt 8 extends beyond an end 27 of the tubular syringe tip receiver 9. This skirt, shown in FIG. 5, has opposed ribbed arcuate sections 28 and 29 and flat surfaces 30 and 31 for easy gripping.

Figure 6:
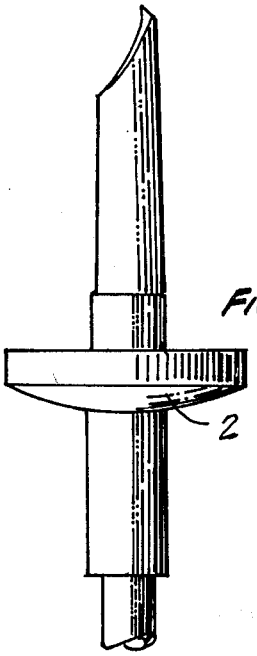
FIG. 6 is an enlarged view of the reservoir spike of FIG. 1.
Figure 8:
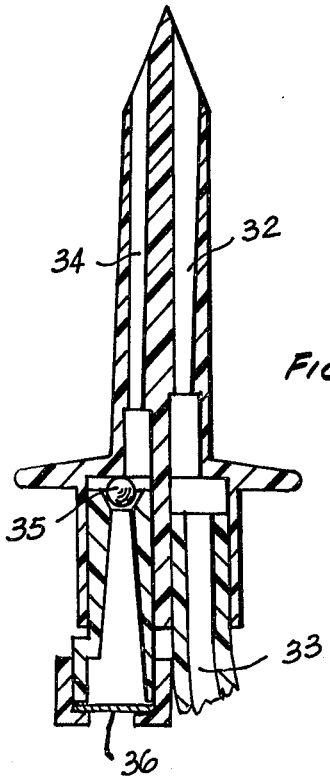
FIG. 8 is a sectional view of the alternate spike of FIG. 7 taken along line 8—8.

FIG. 6 is an enlarged view of the spike 2 shown in FIG. 1. As explained, this spike is intended for use with a container having a separate air tube. An alternate dual passage spike is shown in FIG. 8. This alternate spike has a first passage 32 joined to a flexible tube 33. A second passage 34 connects with a ball check valve 35 which is backed up with a filter 36. Thus air can enter through passage 34 into a bottle without an air tube. Check valve 35 prevents liquid seeping from such bottle, and filter 36 prevents contaminated air from entering the bottle. Either embodiment of the spike will preferably have a removable sterility protector (not shown) on it when sold, and such protector will be removed immediately prior to use.

We have found the invention described above works very well with the tubing made of flexible polyvinylchloride, the coupler made of rigid polycarbonate, the collapsible valve made of rubber, such as silicone rubber, and the spike made of rigid polycarbonate thermoplastic.

In the foregoing description, specific embodiments have been used to illustrate the invention. However it is understood that certain modifications can be made to these embodiments by those skilled in the art without departing from the spirit and scope of the invention.

We claim:

1. An extension transfer set for filling a plurality of syringes or the like from a reservoir container comprising: a flexible tube; a reservoir connector attached to one end of the tube; a syringe coupler connected to an opposite end of the tube, said coupler including a valve having means that opens upon insertion of a blunt syringe tip into the coupler and closes upon removal of such syringe tip; said coupler having a forwardly extending internally tapered syringe tip sealing sleeve; and a protector skirt projecting forwardly beyond said sealing sleeve and spaced radially outward therefrom to define an annular recess of a size to receive a conventional threaded collar surrounding a tapered syringe tip, said sealing sleeve having a wall sufficiently thin to be received between such conventional syringe tip and surrounding threaded collar.

2. An extension transfer set as set out in claim 1, wherein the reservoir connector is a tubular spike.

3. An extension transfer set as set out in claim 2, wherein the spike has two passages, one passage being connected to the tube, and the other passage containing a filtered and check valve and being adapted to provide a filtered inlet vent to a reservoir container.

4. An extension transfer set as set forth in claim 1, wherein the coupler has a tubular syringe tip receiver with an internal luer taper adapted to wedgingly form a seal with a luer tapered tip of a syringe.

5. An extension transfer set as set forth in claim 1, wherein the coupler has a valve member that is longitudinally collapsible upon contact with a blunt syringe tip.

6. An extension transfer set as set forth in claim 5, wherein the valve member is resilient and had a longitudinally collapsible skirt and a grooved sealing head.

7. An extension transfer set for filling a plurality of syringes or the like from a reservoir container comprising: a flexible tube; a reservoir connector attached to one end of the tube; a syringe coupler connected to an opposite end of the tube and having a forwardly extending internally tapered syringe tip sealing sleeve and a protector skirt projecting forwardly beyond said sealing sleeve and spaced radially outward therefrom to define an annular recess of a size to receive a conventional threaded collar surrounding a tapered syringe tip, said sealing sleeve having a wall sufficiently thin to be received between such conventional syringe tip and surrounding threaded collar, said coupler including a valve having means that opens upon insertion of a blunt syringe tip into the coupler and closes upon removal of such syringe tip; and a removable protector closing off the syringe tip coupling passage.

8. An extension transfer set as set forth in claim 7, wherein the coupler has a tubular syringe tip receiver with an internally tapered wall surface, and the removable protector has an externally tapered plug wedgingly secured to the tapered wall of the tubular syringe tip receiver, and the protector has a skirt which externallly surrounds the tubular syringe tip receiver.

9. An extension transfer set for filling a plurality of syringes or the like from a reservoir container comprising: a flexible tube; a reservoir connector attached to one end of the tube; an internally tapered syringe coupler connected to an opposite end of the tube, said coupler including a forwardly extending syringe tip coupling sleeve and a protector skirt projecting forwardly beyond said sealing sleeve and spaced radially outward therefrom to define an annular recess of a size to receive a conventional threaded collar surrounding a tapered syringe tip, said sealing sleeve having a wall sufficiently thin to be received between such conventional syringe tip and surrounding threaded collar and a valve having means that opens upon insertion of a blunt syringe tip into the coupler and closes upon removal of such syringe tip; and said extension transfer set includes an internal fluid passage having a filter therein.

10. An extension transfer set as set forth in claim 9, wherein the filter is secured within the syringe coupler.

11. An extension transfer set for filling a plurality of syringes or the like from a reservoir container comprising: a flexible tube; a reservoir connector attached to one end of the tube a nozzle coupler connected to an opposite end of the tube, said coupler including a valve having means that opens upon sealing engagement of a blunt tubular nozzle with the coupler and closes upon disengagement of such nozzle from the coupler; said coupler including a forwardly extending an internally tapered sealing sleeve for coupling with the nozzle; and there is a protector skirt projecting forwardly beyond said sealing sleeve and spaced radially outward therefrom to define an annular recess of a size to receive a conventional threaded collar surrounding a nozzle, said sealing sleeve having a wall sufficiently thin to be received between such conventional nozzle and surrounding threaded collar.

12. A system for filling syringes or the like with doses of fluid comprising: a reservoir container with fluid therein; a tubular reservoir connector secured to such reservoir container providing an outlet from said container; a flexible tube secured to the tubular reservoir connector; a valved coupler connected to the flexible tube at a distance spaced from the reservoir connector, said coupler including a valve having means that opens upon insertion of a blunt tubular nozzle into sealing engagement with said coupler and closes upon removal of such nozzle from the coupler; said coupler including a forwardly extending internally tapered sleeve for sealing engagement with a blunt tubular nozzle; and a protector skirt projecting forwardly beyond said sealing sleeve and spaced radially outward therefrom to define an annular recess of a size to receive a conventional threaded collar surrounding a nozzle, said sealing sleeve having a wall sufficiently thin to be received between such conventional nozzle and surrounding threaded collar.

13. The system as set forth in claim 12, wherein the valved coupler includes a coupler body with an external protector flange, a transverse wall with an entrance passage surrounded by tubular nozzle receiver having an internal tapered surface; and sealed to this coupler body is a hollow valve housing which has an inlet opening connected to the flexible tube; and a collapsible rubber valve is contained within the valve housing.

14. The system as set forth in claim 13, wherein the reservoir connector is a tubular spike and the reservoir has a separate air inletting tube.

15. The system as set forth in claim 13, wherein the rigid reservoir connector has a first passage connected to the flexible tube and a second passage with a check valve and a filter providing an air inlet vent through the connector into the reservoir.

16. A system for filling syringes or the like with doses of fluid comprising: a reservoir container with fluid therein; a tubular reservoir connector secured to said reservoir container providing an outlet from said container; a flexible tube secured to the tubular reservoir connector; an internally tapered valved coupler connected to the flexible tube at a distance spaced from the reservoir connector, said coupler including forwardly extending tapered syringe tip coupling sleeve and protector skirt projecting forwardly beyond said sealing sleeve and spaced radially outward therefrom a define an annular recess of a size to receive a conventional threaded collar surrounding a nozzle, said sealing sleeve having a wall sufficiently thin to be received between such conventional nozzle and surrounding threaded collar and a valve having means that opens upon insertion of a blunt tubular nozzle into sealing engagement with said coupler and closes upon removal of said nozzle from the coupler; and at least one syringe with a blunt tapered adapter which can sealingly engage with the tubular nozzle receiver of the coupler as the valve structure is pushed open.

* * * * *